US006812194B2

(12) United States Patent
Ruhr et al.

(10) Patent No.: US 6,812,194 B2
(45) Date of Patent: Nov. 2, 2004

(54) ALKALINE METAL CLEANER COMPRISING SULFONATED-HYDROPHOBICALLY MODIFIED POLYACRYLATE

(75) Inventors: Richard O. Ruhr, Buffalo, MN (US); Mark D. Levitt, Saint Paul, MN (US); Edward H. Richardson, Columbia Heights, MN (US); Victor F. Man, St. Paul, MN (US)

(73) Assignee: Ecolab, Inc., St. Paul, MN (US)

( * ) Notice: Subject to any disclaimer, the term of this patent is extended or adjusted under 35 U.S.C. 154(b) by 371 days.

(21) Appl. No.: 09/965,744

(22) Filed: Sep. 28, 2001

(65) Prior Publication Data

US 2003/0109394 A1 Jun. 12, 2003

(51) Int. Cl.[7] ..... C11D 17/00

(52) U.S. Cl. ..... 510/202; 510/421; 510/422; 510/432; 510/475; 510/492; 510/501

(58) Field of Search ..... 510/492, 202, 510/421, 422, 432, 501, 475

(56) References Cited

U.S. PATENT DOCUMENTS

| | | | | |
|---|---|---|---|---|
| 3,419,502 A | | 12/1968 | Newman | 252/180 |
| 3,653,095 A | | 4/1972 | Dupre et al. | 21/2.7 |
| 4,507,219 A | | 3/1985 | Hughes | |
| 4,613,449 A | | 9/1986 | Dingess | 252/174.17 |
| 4,787,999 A | | 11/1988 | Dingess | 252/174.17 |
| 5,030,378 A | | 7/1991 | Venegas | |
| 5,489,531 A | | 2/1996 | Benson | |
| 5,614,027 A | | 3/1997 | Dunn et al. | 134/2 |
| 5,710,116 A | * | 1/1998 | Miracle et al. | 510/276 |
| 5,710,120 A | | 1/1998 | Kanluen et al. | 510/421 |
| 5,803,986 A | * | 9/1998 | Baeck et al. | 134/25.2 |

FOREIGN PATENT DOCUMENTS

| | | |
|---|---|---|
| DE | 1 937 841 | 3/1970 |
| WO | WO 96 29451 A | 9/1996 |
| WO | WO 98/20103 | 5/1998 |
| WO | WO 98/29527 | 7/1998 |
| WO | WO 98/38269 | 9/1998 |
| WO | WO 99/20734 | 4/1999 |

OTHER PUBLICATIONS

Rhodes, F.H. & Berner, F.W., "Effect of Addition Agents upon the Corrosion Rate of Aluminum by Alkalies," *Industrial and Engineering Chemistry,* pp 1336–1337, Dec., 1933.

* cited by examiner

*Primary Examiner*—Necholus Ogden
(74) *Attorney, Agent, or Firm*—Merchant & Gould P.C.

(57) ABSTRACT

The present invention is directed to cleaning compositions for metal surfaces, including both concentrates and ready-to-use solutions. These compositions include a source of calcium ion, a source of alkalinity, a chelating agent, and a surfactant. In some embodiments, a water-soluble or water-dispersible acid-substituted polymer is also included. Additionally, in some embodiments, specific surfactants or chelating agents are used to enhance the performance of the composition.

32 Claims, No Drawings

ALKALINE METAL CLEANER COMPRISING SULFONATED-HYDROPHOBICALLY MODIFIED POLYACRYLATE

FIELD OF THE INVENTION

The invention relates to cleaning compositions and methods of cleaning surfaces with non-corrosive cleaning compositions. In particular, the invention relates to metal cleaning compositions useful in the cleaning articles or surfaces, including soft metal articles or surfaces.

BACKGROUND OF THE INVENTION

Many commercial and domestic articles include surface layers comprising alkaline-sensative metals, for example aluminum or aluminum containing alloys. Such articles are known to those skilled in a variety of occupations or domestic activities, particularly those working in industrial plants, maintenance and repair services, manufacturing facilities, kitchens, restaurants and the like. The types of equipment which can have surface layers including aluminum include, without limitation, sinks, cookware, utensils, surfaces, for example, machine parts, vehicles, tanker trucks, vehicle wheels, work surfaces, tanks, for example soak tanks, hot tanks, immersion vessels (with or without agitators), spray washers (continuous or batch), and ultrasonic baths.

Aqueous alkali cleaners are known as effective cleaning agents. However, many such alkali cleaners have disadvantages when used on alkaline-sensative metals, for example aluminum. One particular disadvantage of using aqueous alkali systems to clean metal surfaces is the potential to corrode or discolor the surfaces. It is difficult to obtain an aqueous detergent solution at an effective pH to remove the soils, such as greases and oils, which often contaminate metal surfaces, and which would not be corrosive to the metal substrate. While aqueous cleaning solutions having a high pH are often more corrosive than aqueous solutions having a relatively low pH, corrosion and discoloration can still be problematic with the more mild solutions.

Various corrosion inhibitors are known and have been used to prevent corrosion of surfaces that come into contact with aqueous alkaline solutions. Some known corrosive inhibitors include the silicates, such as sodium silicate. Unfortunately, the sodium silicates begin to precipitate from aqueous solution at pHs below 11, thus, greatly reducing the effectiveness of these materials to prevent corrosion of the contacted surfaces when used in aqueous cleaning solutions having a lower pH. Additionally, when the silicate-containing compositions or their residues are allowed to dry on the surface to be cleaned, films or spots are often formed, which are visible and which are themselves very difficult to remove. The presence of these silicon-containing deposits can affect the texture of the cleaned surface, the appearance of the surface, and on cooking or storage surfaces, can affect the taste of the materials that come into contact with the cleaned surfaces.

It is also known to include calcium ions within cleaning composition to inhibit the attack of hydroxide ion on alkali sensitive metals. However, it has proven to be difficult to introduce calcium ions into alkaline cleaners without inducing precipitation of hydroxides of the calcium. This is especially true for highly alkaline solutions, such as concentrated solutions that are intended for dilution into use solutions. Theoretically, the protection against corrosion in such systems is based on the presence of the calcium ion in solution, so precipitation of the calcium ions adversely affects the corrosion inhibiting effectiveness of the system. Additionally, the formulations could not include strong chelating agents that could bind with the calcium ion, and again reduce the effectiveness of the calcium ion as a corrosion inhibiter.

Another problem that has been encountered with some such systems is that concentrates, which are formulated to be diluted into use solutions, tend to be sensitive to the use of dilution water with varying amounts of hardness. It has been found that when certain hard water is added, the additional level of calcium added to the cleaning solution can adversely affect the performance of the solution.

SUMMARY OF THE INVENTION

In accordance with the purpose(s) of this invention, as embodied and broadly described herein, this invention, in a first aspect, relates to a cleaning composition that includes at least one source of calcium ion; a source of alkalinity; a sequestering agent capable of complexing with calcium ion in an alkaline environment; a surfactant; and a water-soluble or water-dispersible acid-substituted polymer.

In a second aspect, the present application relates to a cleaning composition that includes a source of calcium ion; a source of alkalinity; a sequestering agent capable of at least partially complexing with calcium ion; and a surfactant selected from primary or secondary alcohol ethoxylate, secondary alkane sulfonate, alpha olefin sulfonate, linear alkyl benzene sulfonate, primary alcohol ethoxy carboxylate, sarcosinates, or mixtures thereof.

In a third aspect, the present invention relates to a cleaning composition that includes a source of calcium ion; a source of alkalinity; a sequestering agent capable of at least partially complexing with calcium ion; and a silicone-containing surfactant.

Another aspect of the present invention includes the cleaning composition of the first, second and third aspects described herein, such that the compositions are made by admixing the components with a solvent.

A further aspect of the present invention relates to a method of treating a metal surface with the cleaning compositions described in the first, second and third aspects, wherein the method includes applying the composition to the metal surface and removing the solution from the metal surface.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE INVENTION

The present invention may be understood more readily by reference to the following detailed description of the invention and their previous and following description.

While the present invention will be described in combination with a particular sequence in the methods, it will be understood that various configurations could be designed within the spirit and scope of this invention to accomplish the methods. Further, the steps of the inventive methods of the present invention may be performed in any order including simultaneously, unless performance of a step requires the product of a previous step. It is also to be understood that the terminology used herein is for the purpose of describing particular embodiments only and is not intended to be limiting.

In this specification and in the claims that follow, reference will be made to a number of terms that shall be defined to have the following meanings:

Reference in the specification and concluding claims to parts by weight of a particular element or component in a composition denotes the weight relationship between the element or component and any other elements or components in the composition or article for which a part by weight is expressed.

The aqueous cleaning solutions of this invention may be used at any temperature, including an elevated temperature of from about 90–180° F. After contact with the cleaning solution, the solution is removed from the metal surface. The contact time of the aqueous cleaning solution with the metal substrates will vary depending upon the degree of contamination but broadly will range between a few seconds or about 1 minute to 30 minutes with 3 minutes to 15 minutes being more typical.

By "alkaline-sensitive metal" as used herein is meant metals including, but not limited to, soft metals such as aluminum, nickel, tin, zinc, copper, brass, bronze and mixtures thereof.

Cleaning compositions for metal surfaces, including both concentrates and ready-to-use solutions, can be provided as compositions including at least one source of calcium ion, at least one source of alkalinity, at least one sequestering agent capable of complexing with calcium ion in an alkaline environment, and at least one surfactant. In some embodiments, at least one water-soluble or water-dispersible acid-substituted polymer is also included. Additionally, in some embodiments, specific surfactants or chelating agents are used to enhance the performance of the composition.

Additional optional additives that are commonly used in moderate to high pH metal cleaning solutions can also be present within the composition. In some embodiments, the composition is an aqueous solution, and an aqueous concentrate system would be diluted prior to application to surfaces. The system can have low levels of silicates or be entirely free of silicates to reduce, avoid or completely eliminate silicon containing deposits from the solution onto the metal surface.

Source of Calcium Ion

The source of calcium ion in the composition can be any source of calcium ion generally known in the art that is compatible with the other components of the composition being used. For example, the source of calcium ion can include calcium salts, calcium oxides, and the like. Some specific examples of sources of calcium ion include calcium acetate and other non-corrosive calcium salts, calcium oxide, calcium chloride, calcium gluconate, and the like.

Source of Alkalinity

The source of alkalinity in the composition can be any source of alkalinity known that is compatible with the other components of the composition being used. Suitable alkaline sources or mixtures thereof useful in the present invention are those capable of providing the desired pH. Alkalinity sources can comprise, for example, inorganic alkalinity sources, such as an alkali metal hydroxide, an alkali metal salt, or the like, or mixtures thereof.

Suitable alkali metal hydroxides include those generally known that are compatible with the other components of the composition being used. Some examples include sodium hydroxide or potassium hydroxide, and the like. An alkali metal hydroxide may be added to the composition in a variety of forms, including for example in the form of solid beads, dissolved in an aqueous solution, or a combination thereof. Alkali metal hydroxides are commercially available as a solid in the form of pilled solids or beads having a mix of particle sizes ranging from about 12–100 U.S. mesh, or as an aqueous solution, as for example, as a 45 wt %, 50 wt % and a 73 wt % solution.

Suitable alkali metal salts include those generally known that are compatible with the other components of the composition being used. Some examples of alkali metal salts include alkali metal silicates, sulfates, borates, acetates, citrates, tartrates, succinates, edates, and the like, and mixtures thereof. Other examples of sources of alkalinity can include ethanolamines and amines; and other like alkaline sources.

Sequestering Agent

The sequestering agent in the composition can be any sequestering agent, including any chelating agent, known that is capable of complexing with the calcium ion in the solution in the desired manner, and that is compatible with the other components of the composition. The sequestering agent is preferably capable of complexing with the calcium ion in an alkaline environment, and is capable of keeping the calcium ions in solution. However, the sequestering agent must not be a strong sequestering agent that would bind with the calcium ion and substantially reduce the effectiveness of the calcium ion to act as a corrosion inhibitor. Therefore, moderately weak calcium chelating agents are preferred. For example, preferred chelating agents include those that are capable of complexing with the calcium ion in concentrated solutions at a pH of 13 and above, with reduced complexing with calcium ion in diluted or use solutions at a pH of below 13.

Exemplary sequestering agents include hydroxymonocarboxylic acid compounds and hydroxypolycarboxylic acid compounds. Suitable hydroxymonocarboxylic acid compounds include, but are not limited to, gluconic acid; glycolic acid; glucoheptanoic acid; lactic acid; methyllactic acid; 2-hydroxybutanoic acid; mandelic acid; phenyllactic acid; glyceric acid; 2,3,4-trihydroxybutanoic acid; and alpha hydroxylauric acid. Preferred hydroxymonocarboxylic acid compounds include gluconic acid and glucoheptanoic acid. Suitable hydroxypolycarboxylic acid compounds include, but are not limited to, citric acid, isocitric acid, tartronic acid; malic acid; tartaric acid; glucaric acid; galactaric acid; mannaric acid; and gularic acid. Preferred hydroxypolycarboxylic acid compounds include citric acid.

Surfactant

The surfactant of the present invention may be any surfactant generally known in the art, such as an anionic surfactant, non-ionic surfactant, cationic surfactant, amphoteric surfactant, or zwitterionic surfactant. In one embodiment, the surfactant has only one surfactant functional group. In a preferred composition of such an embodiment, the surfactant is primary or secondary alcohol ethoxylate, secondary alkane sulfonate, linear alkyl benzene sulfonate, primary alcohol ethoxy carboxylate, sarcosinates, or mixtures thereof.

Anionic surfactants are well known in the detergent, polymer, solution, emulsion and other material arts, and are usually defined by the fact that the hydrophilic segment of the molecule is anionic. The anionic surfactant is usually in the form of a salt, but may also be zwitterionic or an internal salt. Examples include, but are not limited to dimers, trimers, oligomers polymers (copolymers, graft polymers, block polymers, etc.) having anionic surfactant groups thereon, such as amine groups, phosphate groups, or other polar charge centers with hydrophilic and/or hydrophobic contribution segments. Further examples of suitable anionic surfactants include alkali metal salts of alkyl sulfates and alkyl ether sulfates where alkyl is at least $C_{10}$ and the number of alkylene oxide groups is from 2 to 4.

Specific examples of suitable anionic surfactants are water-soluble salts of the higher alkyl sulfates, such as sodium lauroyl sulfate or other suitable alkyl sulfates having 8 to 18 carbon atoms in the alkyl group, alcohol ethoxy carboxylates, secondary alkane sulfonates, linear alkyl benzene sulfonates such as sodium dodecyl benzene sulfonate, and the substantially saturated higher aliphatic acyl amides of lower aliphatic amino carboxylic acid compounds, such as those having 12 to 16 carbons in the fatty acid, alkyl or acyl radicals, and the like. Examples of the last mentioned amides are N-lauroyl sarcosinate, and the sodium, potassium, and ethanolamine salts of N-lauroyl, N-myristoyl, or N-palmitoyl sarcosinate.

Other surfactants can be used in the compositions of this invention other than or in addition to the above-described surfactants. For example, Applicants have surprisingly discovered that silicone-containing surfacants are desirable surfactants due to their corrosion inhibiting properties. Silicone surfacants, for the purpose of this invention, are defined as those surfacants that have a polydimethyl siloxane backbone with functional groups including one or more of quaternary ammonium, carboxyl, betaine, copolyol, and the like. One preferred silicone-containing surfactant is silicone poly-betaine.

Suitable non-ionic surfactants include ethoxylated long chain alcohols such as those sold by Tomah Chemical Co. under the trade name "Tomadol." Further exemplary non-ionic surfactants include alcohol alkoxylates and amine oxides such as alkyl dimethylamine oxide.

Acid Substituted Polymer

The acid-group substituted polymer must be at least water-dispersible and preferably water-soluble, such as acid-substituted acrylic polymers (both acrylic and some methacrylic polymers and copolymers). The acid-substituted polymer may comprise a dispersing agent for aqueous alkaline solutions, and acts to both reduce the corrosion effects of the solution on metal (specifically on aluminum) and to stabilize the tolerance of the solution to hard water addition. Polymers may have a wide range of molecular weights, exemplified, but not limited by the range of 250 to 50,000, or 400 to 25,000, or 400 to 5,000, or 400 to 1,500.

In one embodiment, the acid-substituted polymer contains an acrylic polymer. The acrylic polymer may have acid groups such as sulfonic acid, sulfinic acid, phosphoric acid, phosphonic acid, and carboxylic acid substituted on the polymer. Moreover, the acrylic polymer may contain a sulphonated-hydrophobically modified polyacrylate, or a hydrophobically modified copolymer. Such a hydrophobically modified polyacrylate or copolymer may be modified with styrene or a $C_3$–$C_{22}$ alkyl group.

Other Additives

Other additives may be included in the present metal cleaning compositions and solutions. Other additives may include, but are not limited to, additional surfactants, hydrotropes, additional corrosion inhibitors, antimicrobials, fungicides, fragrances, dyes, antistatic agents, UV absorbers, reducing agents, buffering compounds, corrosion inhibitors, viscosity modifying (thickening or thinning) agents, and the like.

Hydrotopes

Examples of the hydrotropes useful in this invention include the sodium, potassium, ammonium and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols, short chain ($C_6$ or less) alkyl polyglycoside, and sodium, potassium and ammonium salts of the alkyl sarcosinates. The hydrotropes are useful in maintaining the organic materials including the surfactant readily dispersed in the aqueous cleaning solution and, in particular, in an aqueous concentrate which is an especially preferred form of packaging the compositions of the invention and allow the user of the compositions to accurately provide the desired amount of cleaning composition into the aqueous wash solution. A particularly preferred hydrotrope is one that does not foam.

Additional Corrosion Inhibitors

Additional corrosion inhibitors which may be optionally added to the aqueous metal cleaning compositions of this invention include magnesium and/or zinc ions and $Ca(NO_2)_2$. Preferably, the metal ions are provided in water soluble form. Examples of useful water soluble forms of magnesium and zinc ions are the water soluble salts thereof including the chlorides, nitrates and sulfates of the respective metals. If any of the alkalinity providing agents are the alkali metal carbonates, bicarbonates or mixtures of such agents, magnesium oxide can be used to provide the Mg ion. The magnesium oxide is water soluble in such solutions and is a preferred source of Mg ions. In order to maintain the dispersibility of the magnesium and/or zinc corrosion inhibitors in aqueous solution, and in the presence of agents which would otherwise cause precipitation of the zinc or magnesium ions, e.g., carbonates, phosphates, etc., it might be advantageous to include a carboxylated polymer to the solution. The useful carboxylated polymers may be generically categorized as water-soluble carboxylic acid polymers such as polyacrylic and polymethacrylic acids or vinyl addition polymers, in addition to the acid-substituted polymers used in the present invention. Of the vinyl addition polymers contemplated, maleic anhydride copolymers as with vinyl acetate, styrene, ethylene, isobutylene, acrylic acid and vinyl ethers are examples. The polymers tend to be water-soluble or at least colloidally dispersible in water. The molecular weight of these polymers may vary over a broad range although it is preferred to use polymers having average molecular weights ranging between 1,000 up to 1,000,000. These polymers have a molecular weight of 100,000 or less and between 1,000 and 10,000.

The polymers or copolymers (either the acid-substituted polymers or other added polymers) may be prepared by either addition or hydrolytic techniques. Thus, maleic anhydride copolymers are prepared by the addition polymerization of maleic anhydride and another comonomer such as styrene. The low molecular weight acrylic acid polymers may be prepared by addition polymerization of acrylic acid or its salts either with itself or other vinyl comonomers. Alternatively, such polymers may be prepared by the alkaline hydrolysis of low molecular weight acrylonitrile homopolymers or copolymers. For such a preparative technique see Newman U.S. Pat. No. 3,419,502.

The metal cleaning compositions of the present invention are useful for removing any type of contaminant from a metal surface including greases, cutting fluids, drawing fluids, machine oils, antirust oils such as cosmoline, carbonaceous soils, sebaceous soils, particulate matter, waxes, paraffins, used motor oil, fuels, etc. Any metal surface can be cleaned including iron-based metals such as iron, iron alloys, e.g., steel, tin, aluminum, copper, tungsten, titanium, molybdenum, etc., for example. The structure of the metal surface to be cleaned can vary widely and is unlimited. Thus, the metal surface can be as a metal part of complex configuration, sheeting, coils, rolls, bars, rods, plates, disks, etc. Such metal components can be derived from any source including for home use, for industrial use such as from the aerospace industry, electronics industry, etc., wherein the metal surfaces have to be cleaned. Treatment of aluminum surfaces with the compositions of this invention has been found particularly effective.

The aqueous alkaline metal cleaning solutions of this invention comprising the cleaning composition in water have a pH above 7.5, above 9.0, above 10.0, above 11.0, and even up to 13.5. Most preferably, the aqueous alkaline cleaning solutions have a pH which is effective to remove the dirt, grease, oil and other contaminants from the metal surface without causing tarnishing or discoloration of the metal substrate.

It is preferred that the solution have reduced silicate, and more preferred that the compositions of the invention are free of silicates. For example, the concentrate and/or the solution may have less than 0.2 wt. % silicates, less than 0.15 wt. % silicates, less than 0.1 wt. % silicates, less than 0.05 wt. % silicate and less than 0.1 wt. % silicate (down to and preferably including 0 wt. % silicate) and perform in accordance with the teachings of this invention. The addition of larger amounts of silicate is not believed to add benefit to the residue reducing aspects of the present invention, but may not otherwise destroy the cleaning function of the compositions and solutions of this invention. Additionally, in some embodiments, it is preferred to maintain the compositions of this invention substantially silicate-free due to silicate film formation and difficulty in formulating a composition which will remain soluble in aqueous solution at a pH of 11.0 or less when silicates are present. Note, however that this reduced silicate preference does not limit the amount of silicone in the solution as silicone is not included in this definition of silicate.

The composition may be prepared by admixing the components with a solvent, such as an aqueous solution, to form a solution. Commonly, the aqueous solution is water. In general, when the concentration of the composition in the solution is above about 25 wt. %, the solution is considered to be a concentrated solution; and when the concentration of the composition in the solution is below about 25 wt. %, the solution is considered to be a use solution. In either the concentrated or use solution, it is preferred that the ingredients of the composition do not precipitate out when the water has a hardness of 14 grains per gallon or less. In particular, it is preferred that salts of the calcuim do not precipitate out of the composition when the water has a hardness of 14 grains per gallon or less.

Some examples of representative constituent concentrations for concentrate compositions embodying the invention can be found in Table 1.

TABLE 1

| Component | Preferred Range | More Preferred Range |
|---|---|---|
| Calcium Ion | about 0.001 mole per liter to about 1 moles per liter | about 0.001 mole per liter to about 0.05 mole per liter |
| Source of Alkalinity | about 0.1 wt. % to about 20 wt. % | about 1 wt. % to about 10 wt. % |
| Chelating Agent | about one mole or more per mole of calcium ion | about one to two moles per mole of calcium ion |
| Surfactant | about 0.05 wt. % to about 20 wt. % | about 0.25 wt. % to about 10 wt. % |
| Acid-substituted polymer | 0 wt. % to about 10 wt. % | about 0.25 wt. % to about 10 wt. % |

Some examples of representative constituent concentrations for use solution compositions embodying the invention can be found in Table 2.

TABLE 2

| Component | Preferred Range | More Preferred Range |
|---|---|---|
| Calcium Ion | about 0.00001 mole per liter to about 0.1 mole per liter | about 0.0001 mole per liter to about 0.0005 mole per liter |
| Source of Alkalinity | about 0.01 wt. % to about 10 wt. % | about 0.05 wt. % to about 5 wt. % |
| Chelating Agent | about one mole or more per mole of calcium ion | about one to two moles or more per mole of calcium ion |
| Surfactant | about 0.001 wt. % to about 10 wt. % | about 0.005 wt. % to about 2 wt. % |
| Acid-substituted polymer | 0 wt. % to about 1 wt. % | about 0.01 wt. % to about 1 wt. % |

The cleaners of the invention may exist in a use solution or concentrated solution that is in any form including liquid, gel, paste, solids, slurry, and foam. The cleaning solutions are suitable to treat any metal surface contaminated with a wide variety of contaminants. Exemplary contaminants include grease, clay, dirt, and oxide by-products The present solutions may be used by contacting the contaminated metal parts with an effective amount of the aqueous solution. Preferred contact methods include immersion or some type of impingement in which the cleaning solution is circulated or continuously agitated against the metal part or is sprayed thereon. Alternatively, agitation can be provided as ultrasonic waves.

Experimental

The following examples are put forth so as to provide those of ordinary skill in the art with a complete disclosure and description of how the methods claimed herein are made and evaluated, and are intended to be purely exemplary of the invention and are not intended to limit the scope of what the inventors regard as their invention. Efforts have been made to ensure accuracy with respect to numbers (e.g., amounts, temperature, etc.) but some errors and deviations should be accounted for. Unless indicated otherwise, percent is percent by weight given the component and the total weight of the composition, temperature is in ° C. or is at ambient temperature, and pressure is at or near atmospheric.

The following chemicals were used as exemplary embodiments or as ingredients in the formulations of the examples:

| Chemical Name | Chemical Content |
|---|---|
| Alcosperse 725 | Sulphonated hydrophobically modified polymer solution 35% |
| SAS | Secondary alkane sulphonate 30% |
| SXS | Sodium xylene sulphonate 40% |
| Hamposil O | Oleoyl sarcosine 94% |
| Gerapon TC-42 | Sodium N-methyl-N-cocoyl taurate 24% |
| Stepanol CS-460 | Sodium lauroyl ether sulphate 60% |
| Glucopon 625 | C12–16 alkyl polyglycoside 50% |
| Supra 2 | Cocamine oxide 30% |
| Gafac RA-600 | Linear alcohol ethoxylate phosphate ester 99% |
| Chemax AC 5144 | Complex amine carboxylate |
| Bioterge AS-40 | C14–16 Alpha olefin sulphonate 40% |
| Mirataine CBS | Cocamidopropyl hydroxy sultaine 50% |
| LAS | Linear alkyl benzene sulphonic acid 97% |
| Hampshire LED3 | N-Lauroyl N,N',N' ethylenediaminetetraacetate |
| Abil B9950 | Dimethicone propyl PG betaine 30% |
| Variquat CC42 | PPG Diethylmonium chloride 99% |

EXAMPLE 1

| Base formula reference<br>Ingredients | FORMULA 1<br>Weight % |
|---|---|
| Water | 66.596 |
| Alcosperese 725 | 6.25 |
| Calcium Oxide | 0.954 |
| Gluconic Acid (50%) | 13.35 |
| NaOH (50%) | 12.85 |

Calcium oxide and gluconic acid react in situ to form calcium gluconate. To the above base formula, we add an anionic surfactant that further enhances the base formula's corrosion inhibition. Hydrotrope can be added as needed. The following is an example:

| Ingredients | Weight % |
|---|---|
| Base Formula | 66.67 |
| SAS 30% | 6.93 |
| SXS 40% | 26.40 |

That the combination of the alkalinity source, calcium gluconate, sulphonated polyacrylate copolymer, and the anionic surfactant produce a concentrate which, on dilution to a use solution concentration of 2.5%, forms an effective aluminum cleaner. The cleaner is silicate free, non-corrosive to aluminum, and can produce clear 2.5% use solution in a range of water hardness of up to 15 grains per gallon.

The synergistic aluminum corrosion reduction performance of the combination of specific anionic surfactants and calcium when combined in a highly alkaline solution is unusual.

The addition of gluconic acid to form calcium gluconate was necessary for concentrate stability and use solution stability in certain combinations.

The addition of Alcosperese 725 provides further enhancement of the corrosion reduction and also increases the levels of water hardness from which the use solutions can be prepared.

The combination of these elements surprisingly allows for the preparation of stable non-silicated alkaline concentrates from which use solutions that are non-corrosive to aluminum can be made. It is also unusual that the use solutions of the above concentrate can be prepared with water having a range of hardness from softened to fifteen grain well water and remain precipitate free.

| FORMULA<br>Raw Material | 1-1<br>Wt % | 1-2<br>Wt % | 1-3<br>Wt % | 1-4<br>Wt % |
|---|---|---|---|---|
| Hamposil O | 2.5 | | | |
| Gerapon TC-42 | | 8.68 | | |
| NaOH 50% | 0.57 | | | |
| Stepanol CS-460 | | | 4.15 | |
| SAS 30% | | | | 6.94 |
| Base Formula | 79.95 | 66.65 | 79.11 | 66.66 |
| SXS 40% | 16.98 | 24.67 | 7.91 | 26.40 |
| Soft Water | | 0 | 8.83 | |
| Total | 100.00 | 100.00 | 100.00 | 100.00 |
| Panel Appearance | Untouched | Whitened all over | Whitened all over | Whitened a little on the bottom |
| Corrosion (mil/yr) @20.5% | 1.5 | 71.2 | 103.2 | 2.1 |
| Std Deviation (mil/year) (mil = 0.001 in.) | 1.8 | 27.2 | 9.2 | 1.0 |

Corrosion Testing With Al 6061

| Product | Panel # | Mat'l | Density | 10234 Surface Area | Conc. (%) | Time (hours) | Initial Wt | Final Wt | Wt Loss | Adjusted Wt Loss |
|---|---|---|---|---|---|---|---|---|---|---|
| 1.1 | 1 | Al | 2.81 | 6.5000 | 2.5 | 6.0 | 8.1900 | 8.0786 | 0.0304 | 0.0298 |
| | 2 | Al | 2.81 | 6.5000 | 2.5 | 6.0 | 8.0859 | 8.0542 | 0.0317 | 0.0311 |
| | 3 | Al | 2.81 | 6.5000 | 2.5 | 6.0 | 8.2185 | 8.1924 | 0.0216 | 0.0255 |
| 1.2 | 4 | Al | 2.81 | 6.5000 | 2.5 | 6.0 | 8.1459 | 8.1428 | 0.0031 | 0.0025 |
| | 5 | Al | 2.81 | 6.5000 | 2.5 | 6.0 | 8.2160 | 8.2133 | 0.0027 | 0.0021 |
| | 6 | Al | 2.81 | 6.5000 | 2.5 | 6.0 | 8.2453 | 8.2421 | 0.0032 | 0.0026 |
| 1.3 | 7 | Al | 2.81 | 6.5000 | 2.5 | 6.0 | 8.2238 | 8.2019 | 0.0219 | 0.0213 |
| | 8 | Al | 2.81 | 6.5000 | 2.5 | 6.0 | 8.1015 | 8.0735 | 0.0280 | 0.0274 |
| | 9 | Al | 2.81 | 6.5000 | 2.5 | 6.0 | 8.0266 | 8.0021 | 0.0245 | 0.0239 |
| 1.4 | 10 | Al | 2.81 | 6.5000 | 2.5 | 6.0 | 8.0810 | 8.0782 | 0.0028 | 0.0022 |
| | 11 | Al | 2.81 | 6.5000 | 2.5 | 6.0 | 7.9927 | 7.9891 | 0.0036 | 0.0030 |
| | 12 | Al | 2.81 | 6.5000 | 2.5 | 6.0 | 8.1039 | 8.1020 | 0.0019 | 0.0013 |

-continued

Corrosion Testing With Al 6061

| Product | Panel # | Mat'l | Density | 10234 Surface Area | Conc. (%) | Time (hours) | Initial Wt | Final Wt | Wt Loss | Adjusted Wt Loss |
|---|---|---|---|---|---|---|---|---|---|---|
| Control | 13 | Al | 2.81 | 6.5000 | na | 6.0 | 8.0757 | 8.0757 | 0.0000 | −0.0006 |
| | 14 | Al | 2.81 | 6.5000 | na | 6.0 | 8.0427 | 8.0427 | 0.0000 | −0.0006 |
| | 15 | Al | 2.81 | 6.5000 | na | 6.0 | 8.1789 | 8.1783 | 0.0006 | 0.0000 |

The testing performed for this research effort consisted of immersing the test panels of aluminum 6061 grade alloy in a 2.5% formula test solution for six hours at room temperature. The panels were then removed and the panels' appearance was evaluated and results recorded. Post-treatment cleaning was then performed and the resulting MPY (thousands of an inch per year) corrosion rate was calculated.

A variation of Ecolab Food & Beverage Test # 6B Chelation Test For Liquid Alkaline Products consists of heating natural well water with 14–15 grains of hardness in a microwave to greater than 140 degree Fahrenheit and mixing this hot water with room temperature well water from the same source to obtain 135 degree Fahrenheit well water. The correct amount of water and test formula are then combined and mixed well. The test solution is then allowed to cool while sitting at room temperature and the solution is observed for reaction and appearances are recorded.

EXAMPLE 2

The procedure of Example 1 was followed by preparing Formula 1 (base formula), described in Example 1, with various surfactants, as shown for formulas 19-1, 19-2, 19-3 and 19-4 below:

| | FORMULA | | | |
|---|---|---|---|---|
| Raw Material | 19-1 Wt % | 19-2 Wt % | 19-3 Wt % | 19-4 Wt % |
| Gafac FA600 | | | | 0.85 |
| Chemax AC5144 | | | 3.33 | 2.20 |
| NaOH 50% | | 0.5 | | 0.22 |
| Bioterge AS40 | | 1.25 | | |
| LAS 97% | | 2.06 | | |
| Mirataine CBS | 5.75 | | | |
| Base Formula | 80.00 | 80.00 | 80.00 | 80.00 |
| SXS 40% | 14.25 | | 16.67 | 16.73 |
| Soft Water | | 16.19 | | |
| Total | 100 | 100 | 100 | 100 |

All solutions are diluted to 2.5% with soft water to 1000 g. The soft water was allowed to sit in a 5 L pitcher. Three panels are preweighed and placed into the solution with 7–10 minutes between immersion sets. Pre- and post-weights are displayed in the following table. Sample #19-4 was diluted to 27.5 g to 1000 g with soft water instead of 25 g to 1000 g total weight as with the other three samples.

Results: All four samples were found to provide below 250 mil/year corrosion.

Corrosion Testing With A1 6061

| Product | Panel # | Mil per Year | Average Mil per Year | Standard Deviation | Percent Standard |
|---|---|---|---|---|---|
| 19.1 | 1 | 145.36 | 140.48 | 14.30 | 10% |
| | 2 | 151.70 | | | |
| | 3 | 124.39 | | | |
| 19.2 | 4 | 12.19 | 11.71 | 1.29 | 11% |
| | 5 | 10.24 | | | |
| | 6 | 12.68 | | | |
| 19.3 | 7 | 103.90 | 118.05 | 14.93 | 13% |
| | 8 | 133.65 | | | |
| | 9 | 116.58 | | | |
| 19.4 | 10 | 10.73 | 10.57 | 4.15 | 39% |
| | 11 | 14.63 | | | |
| | 12 | 6.34 | | | |
| Control (water) | 13 | −2.93 | −1.95 | 1.69 | −87% |
| | 14 | −2.93 | | | |
| | 15 | 0.00 | | | |

EXAMPLE 3

Alkaline Cleaning Composition

The following solution was prepared as a base formula to check the reaction of a 3% solution of the base formula with Aluminum 6061.

Formula 1.5

| Raw Material | Wt % |
|---|---|
| A. Soft Water | 69.60 |
| B. APG-Glucopan 625 | 10.00 |
| C. Supra 2 | 6.67 |
| D. NaOH 50% | 13.00 |
| E. $CaCl_2.2H_2O$ | 0.73 |

The above composition was fairly viscous and opaque.

Preparing the following A and B solutions examined the effect of addition of Alcosperse 725 to the base formula. Solutions A and B were prepared as follows:

A. A 3% solution of formula 1.5 was prepared by diluting 15.0 g of formula 1.5 to 500.0 g with soft water.

B. A 3% solution of formula 1.5 with the equivalent of the base formula containing 1.0% Alcosperse 725 was prepared by adding 15.0 G formula 1.5 to 470.0 g soft water and mixing. To this solution was added 3% of a 1% Alcosperses 725 solution −15.0 g 1% Alcosperese 725.

An untreated 3"×1" (7.6 cm by 2.5 cm) aluminum panel of alloy 6061 was immersed in each solution A and B for one hour.

At this time, the aluminum panel from solution A had a small amount of bubbles evolving from the surface, indicating some reaction was occurring. The aluminum panel in solution B had no bubbles on the surface indicating no reation was occurring.

Further observations were made to the effect that after 19 hours, 24 minutes: the panel in solution A showed a slight haze in the solution and the panels appeared uncorroded; there were a small amount of bubbles visible on the panel's surface. The panel in solution B remained as a clear solution, the panel looked very good with no negative appearance, no bubbles, and no indication of any reaction.

EXAMPLE 4

Silicone-Containing Surfactant Formulas

Silicone-containing surfactant formulas were prepared with the ingredients described below:

| Ingredients | RM# | 13 | 14 | 15 | 16 | 34 |
|---|---|---|---|---|---|---|
| Water | 100016 | 48.8 | 44.0 | 39.3 | 34.6 | 43.8 |
| Gluconic Acid 50% | 830070 | 8.8 | 13.2 | 17.6 | 22.0 | 8.8 |
| Calcium Oxide | | 0.6 | 0.9 | 1.3 | 1.8 | 0.6 |
| NaOH 50% | 114132 | 8.5 | 8.5 | 8.5 | 8.5 | 8.5 |
| SAS | 180761 | 6.93 | 6.93 | 6.93 | 6.93 | 6.93 |
| SXS | | 26.40 | 26.40 | 26.40 | 26.40 | 26.40 |
| Hampshire LED3 | | — | — | — | — | 5.00 |
| Total | | 100.0 | 100.0 | 100.0 | 100.0 | 100.0 |

-continued

| Ingredients | RM# | 38 | 39 | 40 | 41 | 42 |
|---|---|---|---|---|---|---|
| Water | 100016 | 43.39 | 41.39 | 28.88 | 26.88 | 41.39 |
| Gluconic Acid 50% | 830070 | 8.90 | 8.90 | 22.25 | 22.25 | 8.90 |
| Calcium Oxide | | 0.64 | 0.64 | 1.80 | 1.80 | 0.64 |
| NaOH 50% | 114132 | 8.57 | 8.57 | 8.57 | 8.57 | 8.57 |
| SAS | 180761 | 6.93 | 6.93 | 6.93 | 6.93 | 6.93 |
| SXS | | 26.40 | 26.40 | 26.40 | 26.40 | 26.40 |
| Alcospere 725 | | 4.17 | 4.17 | 4.17 | 4.17 | 4.17 |
| Abil B 9950 | | 1.00 | 3.00 | 1.00 | 3.00 | — |
| Variquat CC-42-5NS | | | | | | 3.00 |
| Total | | 100.0 | 100.0 | 100.0 | 100.0 | 100.0 |

The formulas were tested for corrosion as described in example 3, and the following results were obtained:

| % | Coupon # | Initial Wt (g) | Final Wt (g) | Total Wt Loss (g) | Wt Loss (mg) | Average Wt Loss (mg) | Adjusted Wt Loss (mg) | Corrosion Rate mils/year | Final Appearance |
|---|---|---|---|---|---|---|---|---|---|
| Formula #13 | | | | | | | | | |
| Control Water A1 6061 | 0 | 12.8115 | 12.8108 | 0.0007 | 0.7 | 0.7000 | | | |
| Degreaser @ 2% A1 6061 | 1 | 12.8146 | 12.8118 | 0.0028 | 2.8 | 2.8000 | 2.1000 | 9.8246 | Shiny silver |
| Degreaser @ 4% A1 6061 | 2 | 12.8329 | 12.7583 | 0.0746 | 74.6 | 74.6000 | 73.9000 | 345.7319 | Dull silver |
| Degreaser @ 8% A1 6061 | 3 | 12.8385 | 12.4552 | 0.3833 | 383.3 | 383.3000 | 382.6000 | 1789.9462 | Dull silver; some white markings |
| Degreaser @ 16% A1 6061 | 4 | 12.8374 | 12.0214 | 0.816 | 816 | 816.0000 | 815.3000 | 3814.2790 | Dull silver; some pitting & brown tinting |
| Degreaser @ 32% A1 6061 | 5 | 12.8104 | 11.1377 | 1.6727 | 1672.7 | 1672.7000 | 1672.0000 | 7822.2428 | Dull silver; heavy pitting. |
| Formula #14 | | | | | | | | | |
| Degreaser @ 2% A1 6061 | 6 | 12.7874 | 12.7859 | 0.0015 | 1.5 | 1.5000 | 0.8000 | 3.7427 | Shiny silver; white deposits |
| Degreaser @ 4% A1 6061 | 7 | 12.8794 | 12.8516 | 0.0278 | 27.8 | 27.8000 | 27.1000 | 126.7840 | Dull silver; heavy white streaks |
| Degreaser @ 8% A1 6061 | 8 | 12.8384 | 12.4694 | 0.369 | 369 | 369.0000 | 368.3000 | 1723.0455 | Dull white with little pit & tan markings |
| Degreaser @ 16% A1 6061 | 9 | 12.8264 | 12.0168 | 0.8096 | 809.6 | 809.6000 | 808.9000 | 3784.3374 | Dull with pitting & tan markings |
| Degreaser @ 32% A1 6061 | 10 | 12.8870 | 11.2792 | 1.6078 | 1607.8 | 1607.8000 | 1607.1000 | 7518.6163 | Heavy deep pitting |
| Formula #15 | | | | | | | | | |
| Degreaser @ 2% A1 6061 | 11 | 12.9584 | 12.9487 | 0.0097 | 9.7 | 9.7000 | 9.0000 | 42.1054 | Shiny with white streaks |
| Degreaser | 12 | 12.8401 | 12.8176 | 0.0225 | 22.5 | 22.5000 | 21.8000 | 101.9886 | Dull with white & tan |

-continued

| % | Coupon # | Initial Wt (g) | Final Wt (g) | Total Wt Loss (g) | Wt Loss (mg) | Average Wt Loss (mg) | Adjusted Wt Loss (mg) | Corrosion Rate mils/year | Final Appearance |
|---|---|---|---|---|---|---|---|---|---|
| @ 4% A1 6061 | | | | | | | | | streaks |
| Degreaser @ 8% A1 6061 | 13 | 12.8410 | 12.4974 | 0.3436 | 343.6 | 343.6000 | 342.9000 | 1604.2147 | Slight pitting & tan coloring |
| Degreaser @ 16% A1 6061 | 14 | 12.8751 | 12.1046 | 0.7705 | 770.5 | 770.5000 | 769.8000 | 3601.4130 | Pitting with tan coloring |
| Degreaser @ 32% A1 6061 | 15 | 12.8119 | 11.2305 | 1.5814 | 1581.4 | 1581.4000 | 1580.7000 | 7395.1072 | Heavy deep pitting |
| Formula #16 | | | | | | | | | |
| Degreaser @ 2% A1 6061 | 16 | 12.8397 | 12.8309 | 0.0088 | 8.8 | 8.8000 | 8.1000 | 37.8948 | Shiny with white streaks |
| Degreaser @ 4% A1 6061 | 17 | 12.8599 | 12.8462 | 0.0137 | 13.7 | 13.7000 | 13.0000 | 60.8189 | Shiny with white streaks |
| Degreaser @ 8% A1 6061 | 18 | 12.8258 | 12.5116 | 0.3142 | 314.2 | 314.2000 | 313.5000 | 1466.6705 | Dull slight pitting & tan markings |
| Degreaser @ 16% A1 6061 | 19 | 12.7049 | 11.9928 | 0.7121 | 712.1 | 712.1000 | 711.4000 | 3328.1959 | Lots of tiny pitting; some tan markings |
| Degreaser @ 32% A1 6061 | 20 | 12.8951 | 11.4567 | 1.4387 | 1438.7 | 1438.7000 | 1438.0000 | 6727.5031 | Heavy pitting |
| Formula #34 | | | | | | | | | |
| Degreaser @ 2% A1 6061 | 21 | 12.8451 | 12.8448 | 0.0003 | 0.3 | 0.3000 | 0.3000 | 1.4035 | Shiny |
| Degreaser @ 4% A1 6061 | 22 | 12.8386 | 12.8049 | 0.0337 | 33.7 | 33.7000 | 33.7000 | 157.6612 | Dull; covered with white deposits |
| Degreaser @ 8% A1 6061 | 23 | 12.7980 | 12.6177 | 0.1803 | 180.3 | 180.3000 | 180.3000 | 843.5110 | Shiny with white markings & a few tan |
| Degreaser @ 16% A1 6061 | 24 | 12.8543 | 12.3444 | 0.5099 | 509.9 | 509.9000 | 509.9000 | 2385.5033 | Very tiny pitting |
| Degreaser @ 32% A1 6061 | 25 | 12.8457 | 11.8785 | 0.9672 | 967.2 | 967.2000 | 967.2000 | 4524.9242 | Some pitting |
| Formula #38 | | | | | | | | | |
| Control (Water) A1 6061 | 0 | 12.8321 | 12.8326 | −0.0005 | −0.5 | −0.5000 | | | Shiny silver |
| Degreaser @ 2% A1 6061 | 1 | 12.7553 | 12.7548 | 0.0005 | 0.5 | 0.5000 | 1.0000 | 4.6784 | Shiny with white streaks |
| Degreaser @ 4% A1 6061 | 2 | 12.8140 | 12.7672 | 0.0468 | 46.8 | 46.8000 | 47.3000 | 221.2871 | White dull finish |
| Degreaser @ 8% A1 6061 | 3 | 12.8481 | 12.5081 | 0.34 | 340 | 340.0000 | 340.5000 | 1592.9866 | White dull finish with some grooves marking |
| Degreaser @ 16% A1 6061 | 4 | 12.8343 | 12.0563 | 0.778 | 778 | 778.0000 | 778.5000 | 3642.1148 | Silver with heavy small pit markings |
| Degreaser @ 32% A1 6061 | 5 | 12.8431 | 11.2685 | 1.5746 | 1574.6 | 1574.6000 | 1575.1000 | 7368.9083 | Coupon is thinner with heavy deep pitting |
| Formula #39 | | | | | | | | | |
| Degreaser @ 2% A1 6061 | 6 | 12.8760 | 12.8761 | −1E−04 | −0.1 | −0.1000 | 0.4000 | 1.8713 | Shiny with white streaks |
| Degreaser @ 4% A1 6061 | 7 | 12.7546 | 12.7417 | 0.0129 | 12.9 | 12.9000 | 13.4000 | 62.6902 | Heavy white streaks |
| Degreaser @ 8% A1 6061 | 8 | 12.8627 | 12.5790 | 0.2837 | 283.7 | 283.7000 | 284.2000 | 1329.5941 | White dull finish with some grooves markings |

-continued

| % | Coupon # | Initial Wt (g) | Final Wt (g) | Total Wt Loss (g) | Wt Loss (mg) | Average Wt Loss (mg) | Adjusted Wt Loss (mg) | Corrosion Rate mils/year | Final Appearance |
|---|---|---|---|---|---|---|---|---|---|
| Degreaser @ 16% A1 6061 | 9 | 12.8660 | 12.1074 | 0.7586 | 758.6 | 758.6000 | 759.1000 | 3551.3544 | Silver with heavy small pit markings |
| Degreaser @ 32% A1 6061 | 10 | 12.8415 | 11.2872 | 1.5543 | 1554.3 | 1554.3000 | 1554.8000 | 7273.9372 | Coupon is thinner with heavy deep pitting |
| Formula #40 | | | | | | | | | |
| Degreaser @ 2% A1 6061 | 11 | 12.8333 | 12.8336 | −0.0003 | −0.3 | −0.3000 | 0.2000 | 0.9357 | Shiny with very little white markings |
| Degreaser @ 4% A1 6061 | 12 | 12.8705 | 12.8693 | 0.0012 | 1.2 | 1.2000 | 1.7000 | 7.9532 | Shiny with little grooves |
| Degreaser @ 8% A1 6061 | 13 | 12.8344 | 12.8259 | 0.0085 | 8.5 | 8.5000 | 9.0000 | 42.1054 | Shiny with little grooves and 2 white marks |
| Degreaser @ 16% A1 6061 | 14 | 12.8288 | 12.3509 | 0.4779 | 477.9 | 477.9000 | 478.4000 | 2238.1345 | Dull with very tiny pitting markings |
| Degreaser @ 32% A1 6061 | 15 | 12.8621 | 11.8031 | 1.059 | 1059 | 1059.0000 | 1059.5000 | 4956.7382 | Dull with very tiny pitting markings |
| Formula #41 | | | | | | | | | |
| Degreaser @ 2% A1 6061 | 16 | 12.5314 | 12.5317 | −0.0003 | −0.3 | −0.3000 | 0.2000 | 0.9357 | Shiny with very little white markings |
| Degreaser @ 4% A1 6061 | 17 | 12.8756 | 12.874 | 0.0016 | 1.6 | 1.6000 | 2.1000 | 9.8246 | Shiny with little grooves |
| Degreaser @ 8% A1 6061 | 18 | 12.8251 | 12.8175 | 0.0076 | 7.6 | 7.6000 | 8.1000 | 37.8948 | Shiny with little grooves |
| Degreaser @ 16% A1 6061 | 19 | 12.7719 | 12.3903 | 0.3816 | 381.6 | 381.6000 | 382.1000 | 1787.6070 | Shiny with little grooves and 2 white marks |
| Degreaser @ 32% A1 6061 | 20 | 12.8328 | 11.8318 | 1.001 | 1001 | 1001.0000 | 1001.5000 | 4685.3924 | Shiny with little grooves and 2 white marks |
| Formula #42 | | | | | | | | | |
| Degreaser @ 2% A1 6061 | 21 | 12.8267 | 12.8235 | 0.0032 | 3.2 | 3.2000 | 3.2000 | 14.9708 | ⅓ of coupon covered with white film |
| Degreaser @ 4% A1 6061 | 22 | 12.8386 | 12.6682 | 0.1704 | 170.4 | 170.4000 | 170.4000 | 797.1951 | Dull with white film |
| Degreaser @ 8% A1 6061 | 23 | 12.7980 | 12.4924 | 0.3056 | 305.6 | 305.6000 | 305.6000 | 1429.7114 | Dull with small pit markings |
| Degreaser @ 16% A1 6061 | 24 | 12.8543 | 12.0498 | 0.8045 | 804.5 | 804.5000 | 804.5000 | 3763.7526 | Heavy pitting |
| Degreaser @ 32% A1 6061 | 25 | 12.8457 | 11.429 | 1.4167 | 1416.7 | 1416.7000 | 1416.7000 | 6627.8537 | Larger deep pit markings |

Throughout this application, various publications are referenced. The disclosures of these publications in their entireties are hereby incorporated by reference into this application in order to more fully describe the state of the art to which this invention pertains.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A cleaning composition comprising:

a) a source of calcium ion;

b) a source of alkalinity;

c) a sequestering agent capable of complexing with calcium ion in an alkaline environment;

d) a surfactant; and e) a sulphonated-hydrophobically modified polyacrylate.

2. The composition of claim 1, wherein the sulphonated-hydrophobically modified polyacrylate is modified with styrene or a $C_3$–$C_{22}$ alkyl group.

3. The composition of claim 1, wherein the composition further comprises a solvent to form a use solution, and the concentration of the composition in the use solution, and the concentration of the composition in the use solution is from about 0.5 wt. % to about 20 wt. % of the total use solution.

4. The composition of claim 1, wherein the composition has less than about 0.5 wt. % by total weight of the composition as silicate.

5. The composition of claim 1, wherein the composition is prepared by admixing the components a, b, c, d, and e with a solvent.

6. The composition of claim 1, wherein the composition has a molar concentration of calcium ion from about 0.00 1 to about 1 moles per liter of composition.

7. The composition of claim 6, wherein the composition has about one or more moles of sequestering agent for every mole of calcium ion in the concentrated composition.

8. The composition of claim 1, wherein the composition comprises a concentrated cleaning solution comprising:

a) from about 0.001 mole to about 1 mole of calcium ion per liter of solution;

b) from about 0.1 wt. % to about 20 wt. % source of alkalinity;

c) about one mole or more of sequestering agent for each mole of calcium ion;

d) from about 0.05 wt. % to about 20 wt. % surfactant; and e) from about 0.25 wt. % to about 10 wt. % sulphonated-hydronhobically modified polyacrylate.

9. The composition of claim 1, wherein the composition comprises a use solution comprising:

a) from about 0.00001 mole to about 0.1 mole of calcium ion per liter of solution;

b) from about 0.01 wt. % to about 10 wt. % source of alkalinity;

c) about one mole or more of sequestering agent for each mole of calcium ion;

d) from about 0.001 wt. % to about 10 wt. % surfactant; and e) from about 0.01 wt. % to about 1 wt. % sulphonated-hydrophobically modified polyacrylate.

10. A cleaning composition comprising:

a) a source of calcium ion;

b) a source of alkalinity;

c) a sequestering agent capable of at least partially complexing with calcium ion;

d) a surfactant selected from the group consisting of: primary or secondary alcohol ethoxylate, secondary alkane sulfonate, secondary alcohol sulfonate, alpha olefin sulfonate, linear alkyl benzene sulfonate, primary alcohol ethoxy carboxylate, sarconsinates, or mixtures thereof; and e) sulphonated-hydrophobically modified polyarcylate.

11. The composition of claim 10, wherein the surfactant is N-acylsarcosinate, secondary alcohol sulfonate, or linear alkyl benzene sulfonate.

12. The composition of claim 10, wherein the surfactant is secondary alcohol sulfonate.

13. The composition of claim 10, wherein the composition further comprises a solvent to form a use solution, and the concentration of the composition in the use solution is from about 0.5 wt. % to about 20 wt. % of the total use solution.

14. The composition of claim 10, wherein the composition has less than about 0.5 wt. % by total weight of the composition as silicate.

15. The composition of claim 10, wherein the composition is prepared by admixing the components a, b, c, and d with a solvent.

16. The composition of claim 10, wherein the composition has a molar concentration of calcium ion from about 0.001 to about 1 moles per liter of composition.

17. The composition of claim 10, wherein the composition has about one or more moles of sequestering agent for every mole of calcium ion in the concentrated composition.

18. The composition of claim 10, wherein the composition comprises a concentrated cleaning solution comprising:

a) from about 0.001 mole to about 1 mole of calcium ion per liter of solution;

b) from about 0.01 wt. % to about 20 wt. % source of alkalinity;

c) about one mole or more of sequestering agent for each mole of calcium ion; and d) from about 0.05 wt. % to about 20 wt. % surfactant.

19. The composition of claim 10, wherein the composition comprises a use solution comprising:

a) from about 0.0001 mole to about 0.1 mole of calcium ion per liter of solution;

b) from about 0.01 wt. % to about 10 wt. % source of alkalinity;

c) about one mole or more of sequestering agent for each mole of calcium ion; and d) from about 0.001 wt. % to about 10 wt. % surfactant.

20. A cleaning composition comprising:

a) a source of calcium ion;

b) a source of alkalinity;

c) a sequestering agent capable of at least partially complexing with calcium ion;

d) a silicone-containing surfactant; and e) a sulphonated-hydrophobically modified polyacrylate.

21. The composition of claim 20, wherein the surfactant is dimethicone propyl PG betaine.

22. The composition of claim 20, wherein the composition further comprises a solvent to form a use solution, and the concentration of the composition in the use solution is from about 0.5 wt. % to about 20 wt. % of the total use solution.

23. The composition of claim 20, wherein the composition has less than about 0.5 wt. % by total weight of the composition as silicate.

24. The composition of claim 20, wherein the composition is prepare by admixing the components a, b, c, and d with a solvent.

25. The composition of claim 20, wherein the composition has a mol concentration of calcium ion from about 0.001 to about 1 moles per liter of composition.

26. The composition of claim 20, wherein the composition has about one or more moles of sequestering agent for every mole of calcium ion in the concentrated composition.

27. The composition of claim 20, wherein the composition comprise a concentrated cleaning solution comprising:

a) from about 0.001 mole to about I mole of calcium ion per liter of solution;

b) from about 0.1 wt. % to about 20 wt. % source of alkalinity;

c) about one mole or more of sequestering agent for each mole of calcium ion; and d) from about 0.05 wt. % to about 20 wt. % surfactant.

28. The composition of claim 20, wherein the composition comprise a use solution comprising:

a) from about 0.00001 mole to about 0.1 mole of calcium ion per liter of solution;

b) from about 0.01 wt. % to about 10 wt. % source of alkalinity;

c) about one mole or more of sequestering agent for each mole of calcium ion; and d) from about 0.001 wt. % to about 10 wt. % surfactant.

29. A method of treating a metal surface, the method comprising: contacting a metal surface with an aqueous cleaning solution comprising the composition of claim 1, 10, or 20; and removing the solution from the metal surface.

30. The method of claim 29 wherein said metal surface comprises an aluminum surface.

31. A cleaning composition comprising:

a) a source of calcium ion;

b) a source of alkalinity;

c) a sequestenng agent capable of at least partially complexing with calcium ion; and d) dimethicone propyl PG betaine.

32. The composition of claim 10, wherein the acid-substituted acrylic polymer is a suiphonated-hydrophobically modified polyacrylate.

* * * * *

UNITED STATES PATENT AND TRADEMARK OFFICE

CERTIFICATE OF CORRECTION

PATENT NO. : 6,812,194 B2
DATED : November 2, 2004
INVENTOR(S) : Ruhr et al.

It is certified that error appears in the above-identified patent and that said Letters Patent is hereby corrected as shown below:

Column 19,
Line 11, “about 0.00 1” should read -- about 0.001 --.
Line 28, “hydronhobically” should read -- hydrophobically --.

Column 20,
Line 49, “is prepare” should read -- is prepared --.
Line 52, “has a mol” should read -- has a molar --.
Line 58, “comprise a” should read -- comprises a --.
Line 59, “to about I mole” should read -- to about 1 mole --.
Line 67, “comprise a use” should read -- comprises a use --.

Column 22,
Lines 11-12, “a suiphonated-hydrophobically” should read
-- a sulphonated-hydrophobically --.

Signed and Sealed this

Twenty-seventh Day of September, 2005

JON W. DUDAS
*Director of the United States Patent and Trademark Office*